US006135120A

United States Patent [19]

Löfman et al.

[11] Patent Number: 6,135,120

[45] Date of Patent: Oct. 24, 2000

[54] DEVICE FOR PACKING OF FINELY DIVIDED, MOISTENED TOBACCO MATERIAL

[75] Inventors: Lars Olof Löfman, Kungälv; Kenth Gamhed, Åsa; Kenneth Ek, Lerum, all of Sweden

[73] Assignee: Swedish Match Sverige AB, Stockholm, Sweden

[21] Appl. No.: 09/214,704

[22] PCT Filed: Jun. 13, 1997

[86] PCT No.: PCT/SE97/01041

§ 371 Date: Jan. 11, 1999

§ 102(e) Date: Jan. 11, 1999

[87] PCT Pub. No.: WO98/08738

PCT Pub. Date: Mar. 5, 1998

[30] Foreign Application Priority Data

Aug. 26, 1996 [SE] Sweden ..... 9603073

[51] Int. Cl.[7] ..... A24B 1/10; A24C 1/08

[52] U.S. Cl. ..... 131/112; 131/115; 131/118; 53/111 R; 53/431; 53/439

[58] Field of Search ..... 131/112, 115, 131/118; 53/111 R, 431, 439

[56] References Cited

U.S. PATENT DOCUMENTS

| | | | |
|---|---|---|---|
| 289,397 | 12/1883 | Dietz | 131/115 |
| 3,565,132 | 2/1971 | Lefort . | |
| 4,617,974 | 10/1986 | Focke et al. . | |
| 4,987,907 | 1/1991 | Townend . | |
| 5,174,088 | 12/1992 | Focke et al. . | |

FOREIGN PATENT DOCUMENTS

| | | |
|---|---|---|
| 858663 | 12/1952 | Germany . |
| 4111786A1 | 1/1992 | Germany . |
| 396748 | 7/1965 | Switzerland . |
| WO87/02326 | 4/1987 | WIPO . |

*Primary Examiner*—Stanley S Silverman
*Assistant Examiner*—Michael P. Colaianni
*Attorney, Agent, or Firm*—Burns, Doane, Swecker & Mathis, L.L.P.

[57] ABSTRACT

A device (1) for packaging finely divided, moistened tobacco material in individual portion packages, comprising a means (2) for feeding the material into pockets (4) formed in a rotary portioning wheel (3) for portioning the material into portions. The device further comprises at least one compression means (10, 11, 12) for compressing these portions, a unit (23, 27) for advancing a packaging material (17) in synchrony with the compressed portions, at least one means (14, 15, 16) for discharging the portions from the pockets and advancing them the packaging material, and a unit (28, 29, 30, 31, 33) for forming individual portion packages from the discharged portions and the packaging material. At the intended point of discharge of the portions to the packaging material, said material has the form of a tape (17), the compression means (10, 11, 12) being arranged to compress the portions in a direction which differs from the discharging and the feeding directions.

10 Claims, 4 Drawing Sheets

DEVICE FOR PACKING OF FINELY DIVIDED, MOISTENED TOBACCO MATERIAL

The present invention relates to a device for packaging finely divided, moistened tobacco material in individual portion packages. The device comprises means for feeding the tobacco material into pockets formed in a rotary portioning wheel for portioning the material in portions, at least one compression means for compressing these portions, a unit for advancing a packaging material in synchrony with the compressed portions, at least one means for discharging the portions from the pockets to the packaging material, and a unit for forming individual portion packages from the discharged portions and the packaging material. This device is intended particularly for packaging of snuff tobacco.

U.S. Pat. No. 4,703,765 discloses a device for packaging precise amounts of finely divided tobacco products, such as snuff tobacco or the like, in a tubular packaging material into which snuff portions are injected via a fill tube. Downstream from the tube, welding means are positioned for transverse sealing of the packaging material, and also cutting means for severing the packaging material in the area of the transverse seal to thus form discrete or individual portion packages. The packages are subsequently packed into snuff boxes. The most serious problem encountered with the device in accordance with this patent specification is that the moisture contents of the tobacco material being injected into the tube must not exceed 30% if one is to avoid clogging of the fill tube. Considering that the end product should have a moisture content of approximately 50%, it becomes necessary to subsequently spray the portion packages with water in order to obtain the desired moisture contents. However, this is a very difficult method of obtaining evenly moistened portion packages all of which are to have a satisfactory moisture content, without using complex systems for moisture content regulation.

In order to avoid post-moisturing of the portion packages the publication DE-41 11 786 suggests that snuff tobacco possessing the desired final moisture content be supplied to pockets formed in a rotary portioning wheel for portioning the material in portions. As the portioning wheel is being rotated, the snuff tobacco inside the pockets is compressed by means of compression pistons operating in the radial direction of the portioning wheel, forcing the snuff tobacco against an external pressure face which abuts against the pocket mouths over part of the wheel circumference. The pistons likewise serve as discharging means downstream from the pressure face, discharging snuff portions into pockets formed in a packaging material, the latter being in the shape of a tape. The packaging material tape is advanced in synchrony with the compressed snuff portions. Once the snuff has been dispensed into the pockets, the latter are sealed, whereupon the packaging material is severed intermediate the pockets.

Unfortunately it has been found that this device does not perform satisfactorily in practice, since for rheological reasons, the portioning-wheel pockets, being too small and too deep, do not allow supply of a tobacco material moistened to a moisture content of 50%. This problem is solved in accordance with this publication by adding supplementary liquid, such as water, to the portioning wheel downstream from the point of snuff feeding. Also in the case of a device designed in accordance with this publication it thus is difficult to ensure an even and high moisture content in the individual portions, unless extensive moisture-content regulating systems are provided. Furthermore, the addition of supplementary liquid also results in the very portioning wheel becoming moist, with the result that the tobacco material adheres to the wheel when next the latter is filled with tobacco material with consequential adherence problems.

Another problem encountered in the case of the device shown in the last-mentioned publication is that in practice it has proved to be difficult to discharge material into the packaging-material pockets, because the pocket walls are prone to bending rather than to moving apart when exposed to external actuation from a separating mechanism, the reason being that the packaging material is made from a thin and flexible material.

One object of the present invention thus is to provide a device for packaging finely divided, moistened tobacco material, which device makes it possible to produce portion packages containing tobacco material having high and even moisture contents without requiring the provision in the device of a complex, difficult-to-regulate and expensive system for moisture-content control, once the original mixture of liquid and finely divided tobacco material has been made, for instance in a snuff tobacco preparing reactor.

Another object of the present invention is to provide a packaging device allowing the snuff portions to be supplied to the packaging material in a simple manner.

These objects are achieved in accordance with the present invention by means of a device for packaging finely divided, moistened tobacco material,.of the kind defined in the introduction, which device is characterized in that at the intended point of discharge of the portions to the packaging material, said material has the form of a tape, the compression means being arranged to compress the portions in a direction which differs from the discharging and the feeding directions.

Because the compression means is arranged to compress the portions in a different direction from the discharging and the feeding directions a pocket is produced having a variable extension in said different direction, in the following referred to as the direction of compression. The result of this arrangement is that during the material supply step the extension of the pocket in the direction of compression exceeds the extension of the pocket during the discharge step, and that consequently the tobacco material is fed into larger-dimension pockets than in the case of the device according to DE-41 11 786. It thus becomes possible to supply tobacco material having a higher moisture content to the portioning-wheel pockets than in the case of the last-mentioned publication and the need for a system controlling the moisture content of the tobacco material, after introduction of that material into the portioning wheel, is obviated. By compressing the portion after feeding but prior to discharge thereof in another direction than the discharge direction it becomes possible to dimension the resulting portion such that its size does not exceed that suggested in said last-mentioned publication.

The compression is effected primarily in a direction perpendicularly to the feeding and discharge directions, particularly in the axial direction of the portioning wheel whereas feeding and discharge in this case are effected in the radial direction of the wheel.

The forming unit may comprise a means for folding the packaging material about the portions, a means for transversely sealing the packaging material intermediate the portions, and a means for severing the packaging material in the area of said transverse seal in order to form discrete, individual portion packages.

The tobacco material intended to be packaged in individual portion packages could be a finely divided tobacco material having a moisture content of 50%, such as snuff tobacco.

The packaging material tape could be a heat-sealable packaging material, such as viscose fibres bonded with a thermoplastic bonding agent.

The invention will be described in closer detail in the following with reference to the accompanying drawings, wherein.

Figure 1:
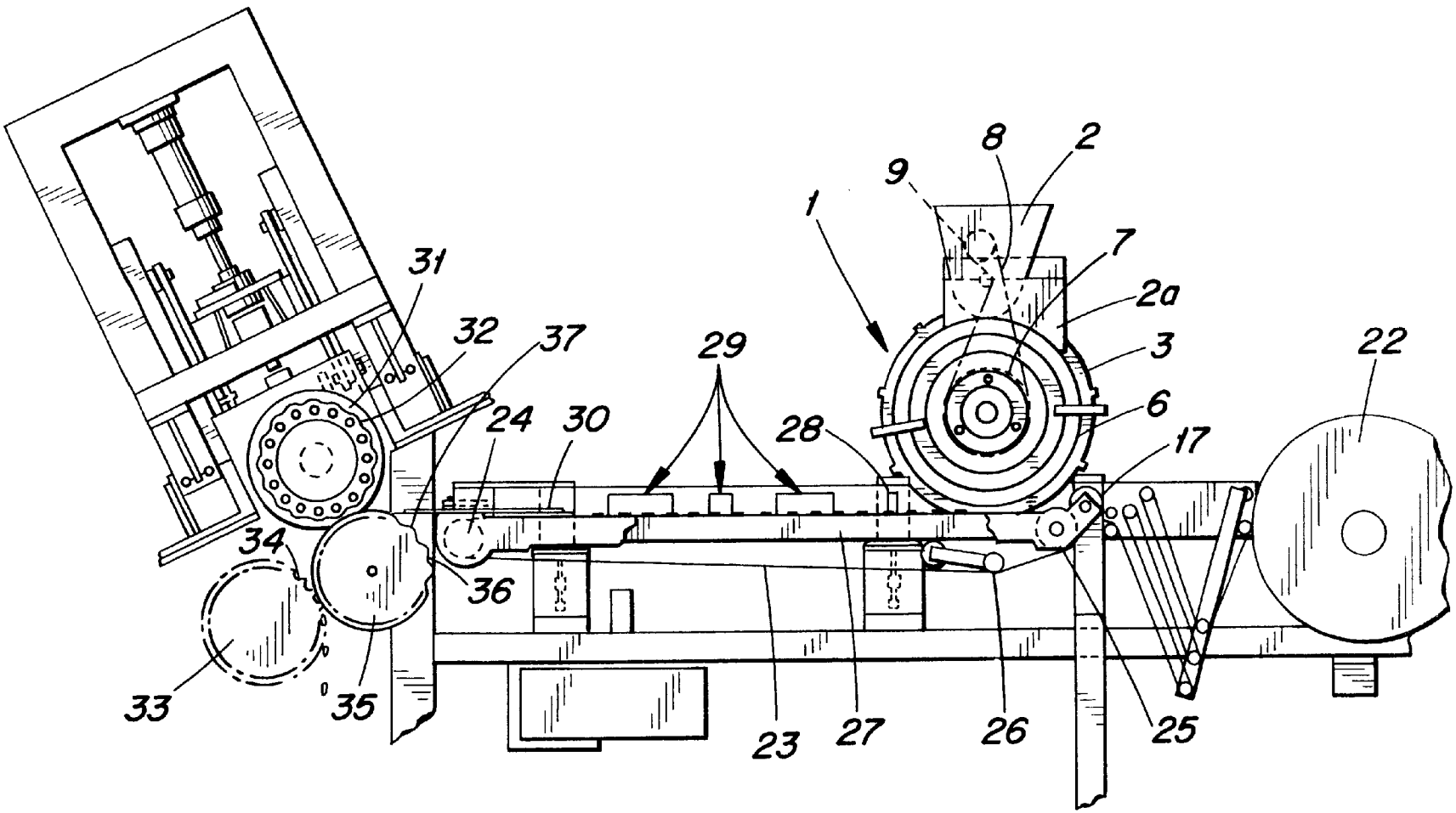
FIG. 1 is a lateral view of a packaging device in accordance with the present invention, comprising a portioning wheel.

The device illustrated in FIG. 1 is intended to be used in conjunction with packaging of for instance snuff tobacco having a moisture content of approximately 50% in discrete individualized portion packages. The device comprises a feeding means in the form of a funnel-shaped feeder container 2 to which prepared snuff tobacco is supplied in any conventional manner, such as through vertically disposed tubes the upper ends of which communicate with a snuff preparatory reactor, not shown, and the lower ends of which are in communication with the feeder container. The packaging device 1 further compromises a rotary portioning wheel 3 having pockets 4 formed therein, see FIG. 2, for portioning the snuff tobacco into portions. During the rotation of the portioning wheel, the pockets will be brought into contact with the lower part of the feeder container 2 and thus be filled with snuff tobacco. A snuff levelling member 5 having three scraper blades is disposed in the lower part of the feeder container to scrape off snuff projecting beyond the respective pocket after filling, in order that snuff portions of a predetermined size be formed. As appears from FIG. 1 the portioning wheel also is fitted with a protective cover 6 and with a belt pulley 7, a driving belt 8 and a driving pulley 9 causing the portioning wheel to rotate at a speed of approximately 40r.p.m. with the aid of a motor, not shown.

Figure 3:
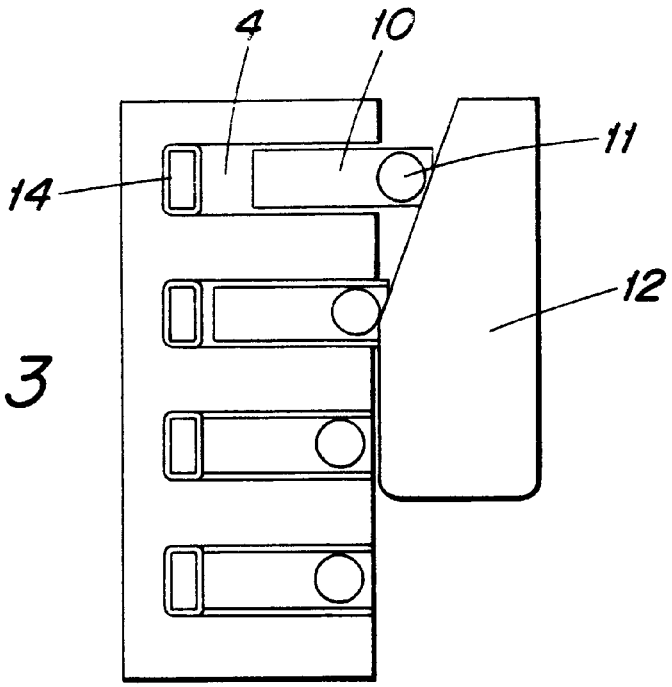
FIG. 3 is a first sectionalized view of the portioning wheel of FIG. 2, the section being taken in the axial direction of the wheel.

FIG. 3 shows that a compression piston 10 is arranged for displacement inside each pocket 4 in the axial direction of the portioning wheel and that a ball bearing 11 is disposed at the outer end of the compression piston. A stationary closing cam member 12 forming an open guide curve forces the compression pistons to move into their respective pocket while compressing snuff tobacco contained inside the pocket. One side wall 2*a* of the feeder container serves as a back-up means during the compression step for exerting pressure on the snuff portion in the radial direction of the portioning wheel, for which reason this container side wall is prolonged and extends somewhat downwardly along the portioning wheel in the direction of rotation of the latter.

Figure 4:
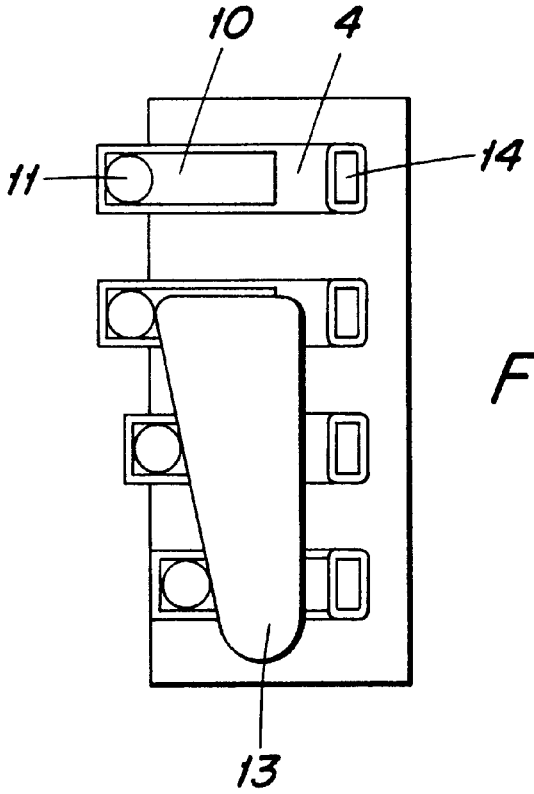
FIG. 4 is a second sectionalized view of the portioning wheel of FIG. 2, the section being taken in the axial direction of the wheel.

FIG. 4 illustrates that the compression pistons are forced to move in the opposite direction when actuated by a stationary opening cam member 13 which likewise forms an open guide curve. The cam member acts on the compression pistons 10 via the ball bearings 11 of the latter.

Figure 5:
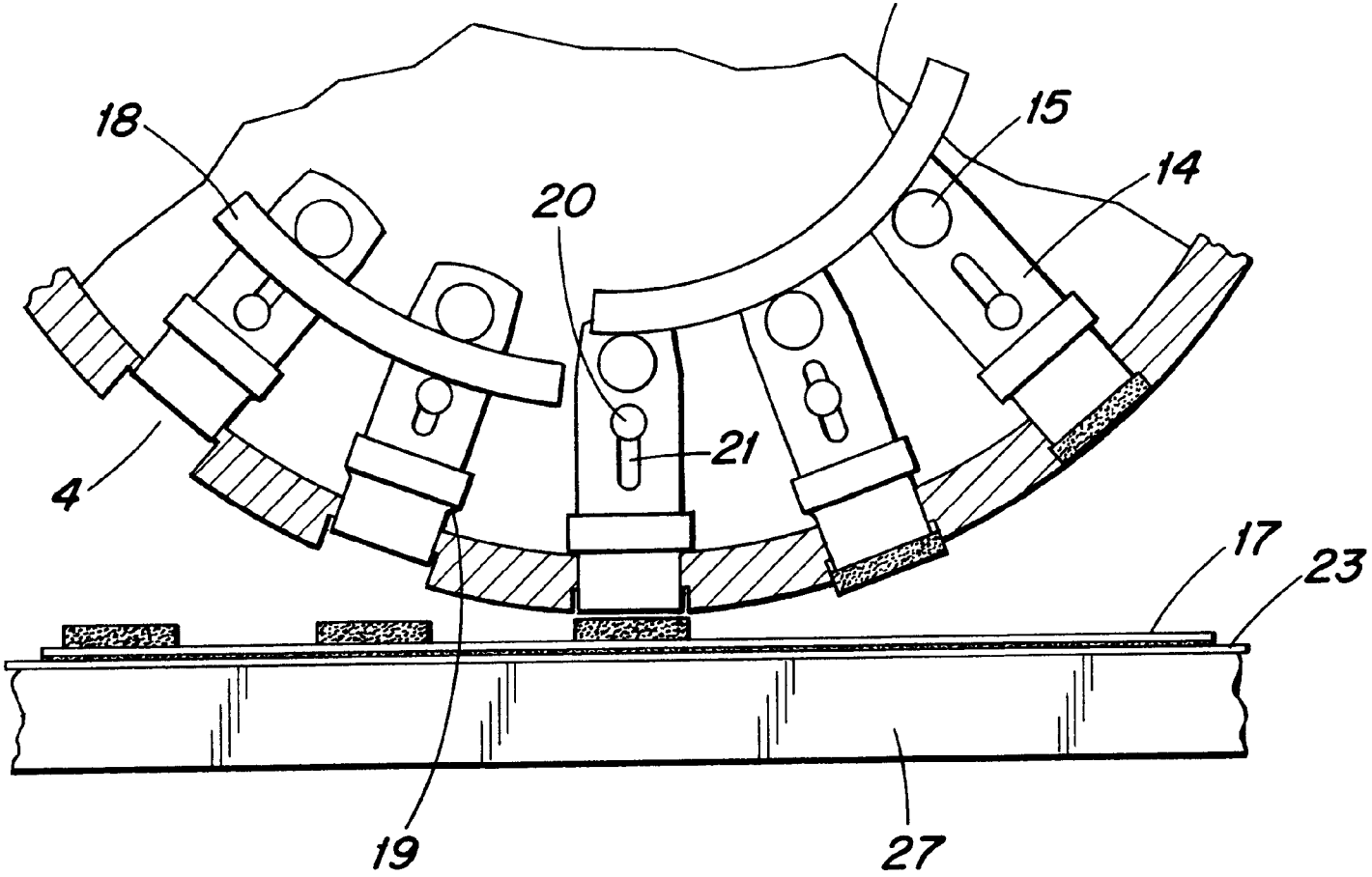
FIG. 5 is an enlarged view of the lower part of the portioning wheel of FIG. 1.

FIG. 5 illustrates that one discharge piston 14 is disposed in each pocket 4 for displacement therein in the radial direction of the portioning wheel, and that a ball bearing 15 is arranged on the outer end of each discharge piston. A stationary discharge cam member which forms an open guide curve forces the discharge pistons to enter their respective pocket, thus expelling the snuff portion from inside the pocket onto a packaging material in the form of a tape 17 which may be made from a material that is permeable to saliva and heat sealable, e.g. from viscose fibres bonded by a thermoplastic bonding agent. As appears from FIGS. 3 and 5 the area of the outer end of the discharge piston equals the entire area of the compressed snuff portion, thus ensuring that all of the snuff portion is discharged to the tape 17. In this manner positively no snuff will remain inside the pocket after the discharging step. This is important in order to avoid adherence problems.

The discharge piston are forced to move in the opposite direction when actuated by a stationary return cam member 18 which likewise forms an open guide curve. Each discharge piston is also provided with a stop means 19 to prevent the piston from projecting beyond the portioning wheel 3 and into contact with the tape 17. In addition, each discharge piston is attached to the wheel itself by means of a screw 20 positioned in a groove 21 formed in the discharge piston. Owing to this arrangement, the piston 14 is movable in the radial direction of the wheel from an inner position adjacent the bottom of the pocket 4 to an outer position adjacent the top of the pocket, the screw 20, when in the inner position, being placed in contact with the outer, i.e. lower, end of the groove 21, and when in the outer position in contact with the inner, i.e. upper, end of the groove, see FIG. 5.

FIG. 1 illustrates the tape 17 being advanced in synchrony with the compressed snuff portions from a reel 22 by means of an endless vacuum suction belt 23 which in turn by means of a motor, not shown, two return pulleys 24, 25 and a belt tightener 26 is rotated around a perforated low pressure chamber 27. The tape supporting the discharged snuff portions thereon thus is made to move in a direction away from the portioning wheel 3 while at the same time the tape is folded about the snuff portions by folding means arranged on top of the low pressure chamber 27. The folding means consists of two L-shaped guides 28 adapted for folding the longitudinal outer marginal portions of the tape 17 upwards, of three shoulders 29 in succession for folding the longitudinal outer marginal portions of the tape 17 downwards, on top of the snuff portions, and of an overlap guide 30 configured as two shoulders, one on either side of the snuff portion, for retaining in position the marginal portions folded on top of the snuff portions. A transverse sealing means in the form of a rotary welding wheel 31 having protruding formations 32 thereon and a severing means in the form of a rotary cutter wheel 33 fitted with cutting knives 34 are positioned downstream from the folding means, the tape being advanced while sucked into close contact with the peripheral surface of a rotary suction wheel 35 formed with depressions 36 which are apertured, not shown, for retaining the snuff portions by suction, alternating with anvil means 37. As illustrated in FIG. 1 the suction wheel is positioned adjacent the return pulley whereas the welding wheel 31 is spaced from the return pulley in such a manner that the plane represented by the axes of rotation of the suction wheel and of the welding wheel are at an angle to the vertical plane. This arrangement facilitates the discharge of the formed, individual snuff portions. In addition, through part of its circumference not engaging the welding wheel or the cutter wheel, the suction wheel 35 is formed with air blower means, not shown, and a screening means, not shown.

Figure 2:
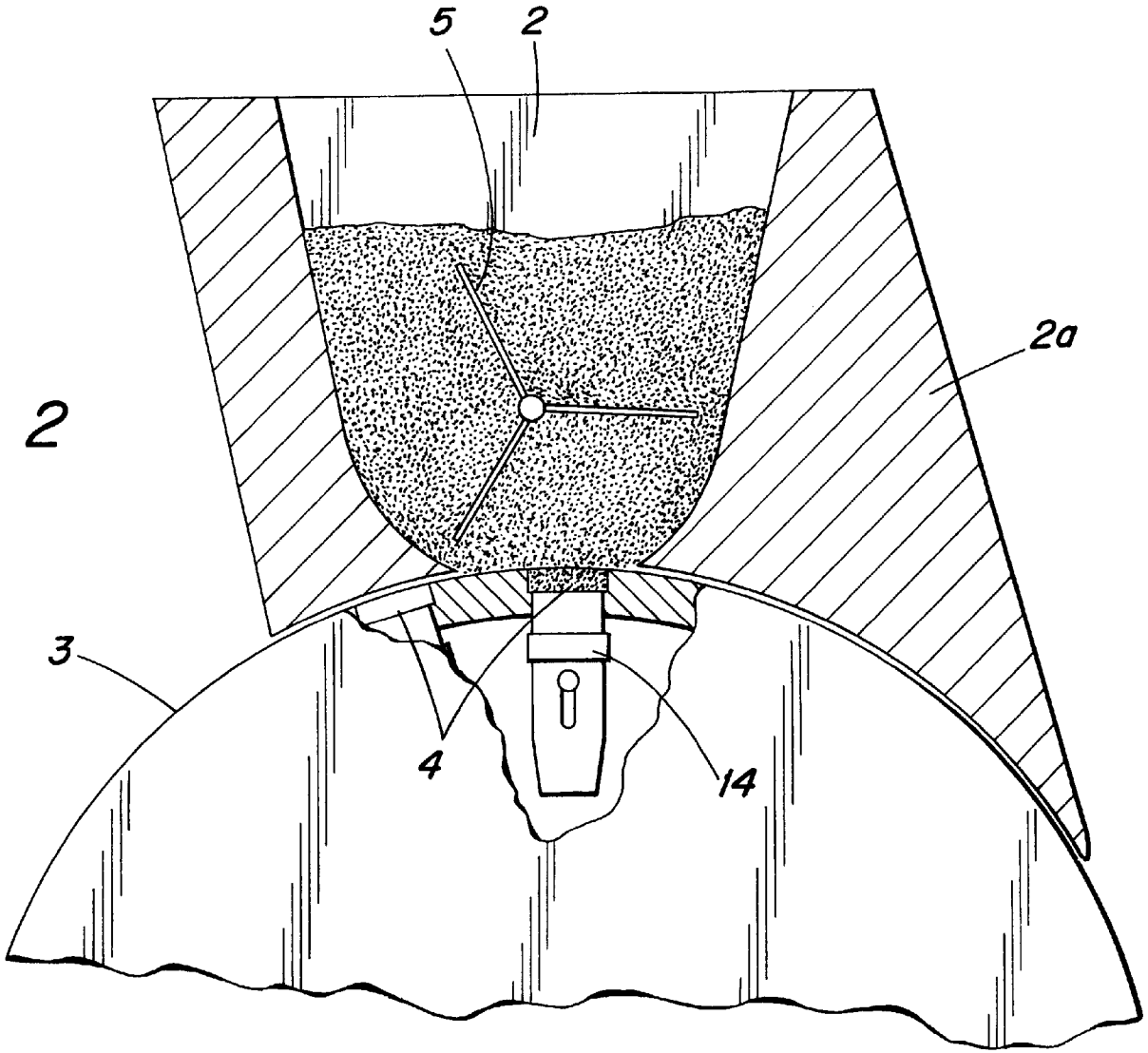
FIG. 2 is a view on an enlarged scale, showing an upper part of the portioning wheel in accordance with FIG. 1.

As the portioning wheel 3 is caused to rotate by means of the above-mentioned motor, an open, empty pocket 4 is advanced to a position underneath the feeder container 2, see FIG. 2. As a result, the entire pocket is filled with snuff tobacco, which is levelled and compressed from above by means of the scraper blades of the snuff levelling member 5. While the snuff portion is being compressed by the compression piston 10 of the pocket, the tobacco portion is simultaneously compressed further by the lateral wall 2a of the feeder container, thus imparting to the snuff portion the desired configuration of discharge.

The entire snuff portion is then ejected from the pocket 4 onto the tape 17 by means of the discharge piston 14, as the discharge cam member 16 causes the piston to move from its inner to its outer position, see FIG. 5. Following the ejection operation, the discharge piston is caused to move in the opposite direction by means of the return cam member 18. Once the discharge piston assumes its inner position, the opening cam member 13 forces the compression piston 10 to move in the direction out of the pocket, allowing the latter to be filled once more the next time it passes underneath the feeder container 2, see FIG. 4.

On account of the changeability of the cam member 13 axially relative to the ball bearing 11 of the compression piston 10 it becomes possible to alter the distance from the inner end of the compression piston 10 to the inner delimiting face of the open pocket 4, see the uppermost pocket 4 in FIG. 4. The volume of the open pocket thus may be adapted to the density of the fully prepared snuff that entering the pocket, thus ensuring that the formed snuff portions have a constant weight, preferably about 1 gram, also when the density varies.

During the rotation of the portioning wheel the tape 17 is being advanced in a flat condition underneath the wheel by means of the endless vacuum suction belt 23, the snuff portions being discharged onto the tape spaced a predetermined distance apart. The distance is determined by the geometrical distance between the pockets in the portioning wheel, the tape advancing speed and the rotational speed of the wheel being synchronous. Following discharge of the snuff portion onto the tape 17, the latter is folded about the discharged portion by the folding means 28, 29, 30 and is then separated from the suction belt and and fed in between the welding wheel 31 and the suction wheel 35 by the overlap guide 30, thus preventing the outer downwards-folded marginal portions of the tape from unfolding prior to welding. The tape is advanced by the suction wheel through the adherence of the snuff portions in the suction wheel depressions 36 by suction, with the additional result that they are fixed in position during the welding of the transverse welds, an operation which is performed by means of the welding wheel protrusions 32 that are positioned in facing relationship to the anvil means 37 on the suction wheel. The tape is then severed along the transverse welds by the knives 34 of the cutter wheel 33 working against the anvil means 37. The individual-portion packages thus formed are then blown away from the suction wheel by the air blower means of the latter and are subsequently supplied to snuff boxes, not shown, by means of some conventional feed-out means. At the same time the suction wheel screening means prevent air from being sucked in from the exterior, after the discharge of the portion packages.

It goes without saying that the invention is not limited to the embodiments described in the a foregoing but that it may be modified in a variety of different ways within the scope of the appended claims.

Instead of using cam mechanisms configured as open guide curves cam mechanisms configured as closed guide curves may be used. The cam members 16 and 18 may for instance be replaced by a closed guide curve in the form of a peripherally extending groove formed in a circular disc, the radius of the groove varying across the disc and being at its maximum at the place of ejection of the snuff portions. The use of a closed-guide curve ensures that the discharge pistons are prevented from moving out of the pockets following the very discharge operation. In accordance with the embodiment shown in FIG. 5 the discharge pistons are prevented from leaving the pockets by the inertia acting on the portioning wheel. Instead of arranging the plane represented by the axes of rotation of the suction wheel 35 and of the welding wheel 31 at an angle relative to the vertical plane it is possible in accordance with a simplified embodiment to place this plane in the vertical plane. The result is a somewhat impaired discharge of the portion packages.

What is claimed is:

1. A device for packaging finely divided, moistened tobacco material in individual portion packages, comprising:

a feeding means for feeding the tobacco material into pockets formed in a rotary portioning wheel for portioning the material into portions, at least one compression means for compressing tobacco material portions, a unit for advancing a packaging material in synchrony with the compressed portions, at least one discharge means for discharging the tobacco material portions from the pockets to the packaging material, and a forming unit for forming individual portion packages from the discharged tobacco material portions and the packaging material, wherein at the intended point of discharge of the tobacco material portions to the packaging material, said packaging material has the form of a tape, the compression means being arranged to compress the tobacco material portions in a direction which differs from the discharging and the feeding directions, wherein the compression is effected in a direction perpendicular to the discharging and the feeding directions, the compression being effected in the axial direction of the portioning wheel whereas the feeding and discharging are effected in the radial direction of said wheel.

2. A device as claimed in claim 1, wherein the forming unit comprises a folding means for folding the packaging material about the tobacco material portions, a sealing means for transversely sealing the packaging material between the portions, and a severing means for severing the packaging material in said transverse seals for forming individual portion packages.

3. A device as claimed in claim 1, wherein the tobacco material to be packaged in portion packages is a finely divided tobacco material having moisture content of about 50%.

4. A device as claimed in claim 3, wherein the tobacco material is snuff tobacco.

5. A device as claimed in claim 1, wherein the packaging material tape includes a heat-sealable packaging material.

6. A device as claimed in claim 5, wherein the packaging material includes viscose fibres bonded by a thermoplastic bonding agent.

7. A device as claimed in claim 2, wherein the tobacco material to be packaged in portion packages is a finely divided tobacco material having moisture content of about 50%.

8. A device as claimed in claim 2, wherein the packaging material tape consists of heat-sealable packaging material.

9. A device as claimed in claim 3, wherein the packaging material tape consists of heat-sealable packaging material.

10. A device as claimed in claim 8, wherein the packaging material tape consists of heat-sealable packaging material.

* * * * *